US010464330B2

(12) United States Patent
Ohnishi

(10) Patent No.: US 10,464,330 B2
(45) Date of Patent: Nov. 5, 2019

(54) LIQUID SUPPLY APPARATUS

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/744,059

(22) PCT Filed: Jul. 14, 2016

(86) PCT No.: PCT/JP2016/070839

§ 371 (c)(1),
(2) Date: Jan. 12, 2018

(87) PCT Pub. No.: WO2017/014148

PCT Pub. Date: Jan. 26, 2017

(65) Prior Publication Data

US 2018/0207938 A1 Jul. 26, 2018

(30) Foreign Application Priority Data

Jul. 17, 2015 (JP) ..... 2015-142990

(51) Int. Cl.
*B41J 2/175* (2006.01)

(52) U.S. Cl.
CPC ..... *B41J 2/1752* (2013.01); *B41J 2/17596* (2013.01)

(58) Field of Classification Search
CPC ..... B41J 2/1752; B41J 2/175; B41J 2/17509; B41J 2/17566; B41J 2/17596
See application file for complete search history.

(56) References Cited

U.S. PATENT DOCUMENTS 5,631,681 A * 5/1997 Klaus ..... B41J 2/17509 347/85
2001/0017642 A1* 8/2001 Shigemura ..... B41J 2/175 347/85

(Continued)

FOREIGN PATENT DOCUMENTS

JP S6381345 4/1988
JP H11142795 2/1999

(Continued)

OTHER PUBLICATIONS

"International Search Report (Form PCT/ISA/210) of PCT/JP2016/070839", dated Oct. 4, 2016, with English translation thereof, pp. 1-4.

(Continued)

*Primary Examiner* — Jason S Uhlenhake
(74) *Attorney, Agent, or Firm* — JCIPRNET

(57) ABSTRACT

An efficiency of a liquid supply to an ejection head such as an inkjet head is improved. An ink supply apparatus is provided that supplies ink to an inkjet head of a printer which is an example of inkjet recording apparatuses. The ink supply apparatus includes a non-replaceable ink pack disposed at a position at which the ink stored inside is suppliable by a hydraulic head differential to the printer, and a replaceable pack holder that replaceably holds a replaceable ink pack provided apart from the non-replaceable ink pack. The ink to be supplied to the non-replaceable ink pack is containable in the replaceable ink pack at a position preceding the non-replaceable ink pack. The ink that the non-replaceable ink pack receives from the replaceable ink pack is supplied to the printer under a pressure generated by the hydraulic head differential.

11 Claims, 6 Drawing Sheets

(56) References Cited

U.S. PATENT DOCUMENTS

| | | | | |
|---|---|---|---|---|
| 2009/0039002 | A1* | 2/2009 | Umeda | B41J 2/17509 210/100 |
| 2014/0247311 | A1* | 9/2014 | Yoshida | B41J 2/1752 347/86 |
| 2015/0266304 | A1* | 9/2015 | Kobayashi | B41J 2/17509 347/86 |

FOREIGN PATENT DOCUMENTS

| | | | |
|---|---|---|---|
| JP | 2002326372 | | 11/2002 |
| JP | 20020326372 | * | 11/2002 |
| JP | 2005212846 | | 8/2005 |
| JP | 2011025477 | | 2/2011 |
| JP | 2011025477 A | * | 2/2011 |
| JP | 2013226830 | | 11/2013 |
| JP | 2014168854 | | 9/2014 |

OTHER PUBLICATIONS

"Office Action of Japan Counterpart Application", dated Jan. 22, 2019, with English translation thereof, p. 1-p. 14.

* cited by examiner

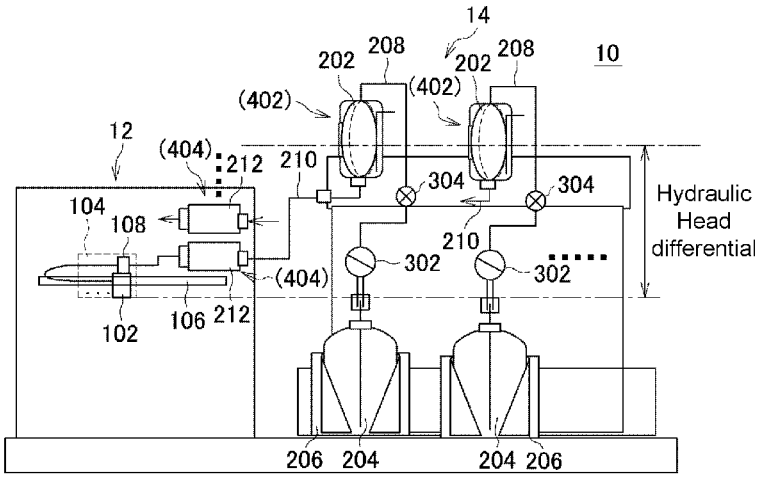

FIG. 1A

| Location | Detected event |
|---|---|
| Replaceable ink pack | No event detected |
| Non-replaceable ink pack | Detection of ink pack almost full to capacity (detection B) |
| | Detection of ink pack almost full to capacity (detection B) |
| Intermediate ink pack | Detection of ink pack volume starting to decrease (detection D) |
| | Detection of ink pack almost full to capacity (detection D) |
| | Detection of ink depletion (detection E) |

FIG. 1B

| | X(L) | Y(L) | Z(L) | Uninterrupted ejection time |
|---|---|---|---|---|
| (a) | 2 | 1 | 0.5 | 7 |
| (b) | 2 | 2 | 0.5 | 9 |
| (c) | 2 | 4 | 0.5 | 13 |

FIG. 5

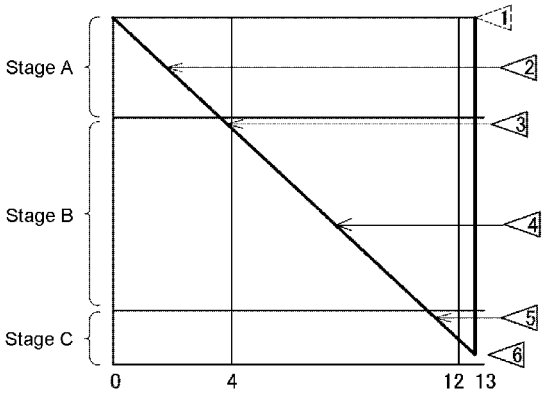

FIG. 6A

| | Place of detection | Detected event |
|---|---|---|
| 1 | No detection | No detection |
| 2 | (a) | Detection of replaceable ink pack volume (ink capacity) equal to or less than a predetermined value |
| 3 | (b) | Detection of non-replaceable ink pack volume starting to decrease |
| 4 | (b) | Detection of non-replaceable ink pack volume equal to or less than a predetermined value |
| 5 | (c) | Detection of intermediate ink pack volume starting to decrease |
| 6 | (c) | Detection of all of ink packs emptied |

FIG. 6B

LIQUID SUPPLY APPARATUS

CROSS-REFERENCE TO RELATED APPLICATION

This application is a 371 application of the international PCT application serial no. PCT/JP2016/070839, filed on Jul. 14, 2016, which claims the priority benefits of Japan application no. 2015-142990, filed on Jul. 17, 2015. The entirety of each of the abovementioned patent applications is hereby incorporated by reference herein and made a part of this specification.

TECHNICAL FIELD

This invention relates to a liquid supply apparatus, a liquid supply method, and a liquid ejection system.

BACKGROUND ART

Printers configured to print an object by inkjet printing, conventionally called inkjet printers, are used in diverse industrial and other applications. As methods for ink supply to inkjet heads of inkjet printers, methods are discussed that supply the inkjet head with ink from an external source of supply (for example, patent literature 1). The patent literature 1 describes an ink supply mechanism that allows for ink supply through an external attachment by utilizing existing ink cartridges of the known inkjet printers.

CITATION LIST

Patent Literature

Patent literature: Japanese Unexamined Patent Publication No. 2005-212846

SUMMARY

Technical Problems

The inkjet printers are used in an even broader range of applications today, and may need to use abundant ink in some occasions. To be specific, huge ink consumption may be inevitable in a long-hour operation of or large-area printing by the inkjet printer. As described in the patent literature 1, an ink supply apparatus may be installed on the outside of the inkjet printer to allow for ink supply from a capacious tank of the apparatus.

Another issue to be contemplated may be fine-tuned adjustments of ink supply pressure, which may be desirable for stability of the ink supply to the inkjet head. In the patent literature 1, pressurized air is introduced from the outside to apply pressure and thereby regulate the supply pressure of the ink from the external tank. Such a method of ink supply, however, may inevitably increase the complexity of an ink supply pressure adjusting mechanism, possibly increasing apparatus costs.

The issue discussed so far is not necessarily limited to the inkjet printers but is involved in other various apparatuses in which droplets are ejected from the ejection head by the inkjet scheme, like the inkjet head. Under the circumstances, configurations have been sought and are desirably found that can more effectively supply liquid, for example, ink, to ink ejection heads such as inkjet heads.

Solutions to the Problems

The inventors of this application conducted studies and researches to find configurations that allow the ink supply for the inkjet heads to be more effectively performed. The inventors particularly focused on possible low-cost methods and apparatuses that enable abundant ink supply.

They first contemplated the feasibility of ink supply from an upper position than the inkjet head using hydraulic head differential. This may enable effective ink supply with a simplified structure, and suppress any increase in apparatus costs.

For the ink supply using hydraulic head differential, an ink container for generating the hydraulic head differential should at least be located at least above the inkjet head based on the principle. In case an existing ink cartridge and an external attachment are used in the ink supply, the ink container should also be located above the attachment.

Supply of abundant ink may be feasible by, for example, using a larger ink container. However, more burden and labor may be invested to install such a large ink container at a vertically upper position, possibly leading to other issues. To be specific, the ink container should necessarily be located at an upper position than the inkjet head by at least several tens of centimeters for the ink supply using hydraulic head differential. Long-hour printing using large-sized printers recently available may need such a large amount of ink as 5 L (liter) or more.

If such long-hour printing with heavy ink consumption is dealt with by simply using a larger ink container, the larger ink container containing abundant ink may be very heavy and difficult to be installed at a desired position. For example, an operator may damage his/her back, trying to uplift the ink container, or an operator who lacks a physical strength may not even able to lift it up.

The inventors of this application, through further studies and experiments, came up with the idea of using a plurality of ink containers arranged in multiple stages, instead of just one container, for supply of abundant ink. The inventors further contemplated using some of the ink containers for replacement, and structuring or arranging these containers to be readily replaceable. The container easily replaceable may be a container downsized or disposed at a position at which the container is easily replaceable. When, for example, the inkjet printer continuously operated is consuming a large amount of ink, the ink supply may be effectively performed, with the replaceable container being ready to be replaced with another container whenever necessary. This may be applicable not only to the inkjet printers but also to various occasions in which ejection heads are used. To address these issues of the known art, this invention is directed to providing technical configurations characterized as described below.

[Configuration 1]

This invention provides a liquid supply apparatus that supplies a liquid to an ejection head of an inkjet recording apparatus. The ejection head ejects the liquid in the form of droplets using inkjet scheme. The liquid supply apparatus includes: a first liquid container disposed at a position at which the liquid in the first liquid container is suppliable to the inkjet recording apparatus by a hydraulic head differential; and a replaceable container holder that replaceably holds a second liquid container provided apart from the first liquid container. The liquid to be supplied to the first liquid container is containable in the second liquid container at a position preceding the first liquid container. The liquid that the first liquid container receives from the second liquid container is supplied to the inkjet recording apparatus under a pressure generated by the hydraulic head differential.

According to the liquid supply apparatus configured to use the hydraulic head differential for the liquid supply, the liquid supply to the ejection head may be performed at low cost. Using the hydraulic head differential for the liquid supply may be rephrased as using a pressure generated by the hydraulic head differential for the liquid supply. This apparatus has two liquid storage devices; first liquid container, and second liquid container. The second liquid container, which is replaceably supported, may be structured or located to be readily replaceable. These structural features may facilitate replacement of the containers for the liquid supply.

In this apparatus provided with the first liquid container apart from the second liquid container, the second liquid container may be replaceable during the ongoing liquid supply from the first liquid container to the ejection head. Therefore, an apparatus using an ejection head (for example, inkjet printer) operated for long hours, for example, may continue to be supplied with the liquid such as ink, and the ejection head may be constantly supplied with the liquid.

The first liquid container has a liquid supply part (supply port) through which the liquid from the second liquid container flows in. The first liquid container may be selected from containers that can be securely disposed in the liquid supply apparatus (stationary container).

The pressure generated by the hydraulic head differential may be a pressure resulting from a highest liquid level in the first and second liquid containers. The ejection head may receive the liquid through a pressure regulator (pressure damper) that regulates the supply pressure of the liquid to be supplied to the ejection head at a position immediately before the ejection head. The pressure regulator and the ejection head may be both mounted in a carriage. In case the pressure regulator is further used, the pressure generated by the hydraulic head differential may be a pressure generated by a difference between the highest liquid level and the vertical position of the pressure regulator.

The inkjet recording apparatus ejects droplets of a liquid from the ejection head using the inkjet scheme. The inkjet recording apparatus may be a printer that performs inkjet printing (inkjet printer). The ejection head may be an inkjet head, in which case the liquid supplied to the ejection head is ink. The liquid may be a cleaning liquid.

The liquid supply apparatus may be an independent apparatus apart from the inkjet printer. The liquid supply apparatus supplies the ink to the inkjet head of the inkjet printer through an attachment for external ink supply which is mounted at the position of a cartridge in the inkjet printer. It may be suggested to supply the ejection head with the liquid using a hydraulic head differential generated between the first liquid container and the ejection head. In this instance, the first liquid container is disposed at an upper position in the gravitational direction than the ejection head. It may be suggested to use the hydraulic head differential for the liquid supply from the first liquid container to the inkjet recording apparatus and to use any other methods but the hydraulic head differential in the inkjet recording apparatus for the liquid supply to the ejection head. It may also be suggested to use the hydraulic head differential for the liquid supply until the liquid flows into the liquid container of the inkjet recording apparatus and to use, for example, a pump for the liquid flow from the liquid container to the ejection head.

[Configuration 2]

The inkjet recording apparatus has a third liquid container at a position more upstream than the ejection head in a liquid supply path of the liquid supplied from the liquid supply apparatus to the ejection head. The liquid from the first liquid container is suppliable to and containable in the third liquid container. The liquid is supplied from the first liquid container to the third liquid container by the hydraulic head differential.

According to this configuration, the liquid may be temporarily containable in the third liquid container of the inkjet recording apparatus. This configuration may prevent an unfavorable event, for example, sudden shortage of the liquid during the printing operation (while the inkjet recording apparatus is operating) and may allow the liquid to be reliably supplied to the ejection head. The liquid may be supplied by the hydraulic head differential from the first liquid container of the liquid supply apparatus to the third liquid container of the inkjet recording apparatus. Thus, smooth and sufficient liquid supply may be possible without having to use, for example, a feed pump.

[Configuration 3]

The inkjet recording apparatus further has a pressure regulator that regulates a supply pressure of the liquid to be supplied to the ejection head, and a carriage that holds the ejection head. The pressure regulator is disposed at a position between the third liquid container and the ejection head in the liquid supply path and is mounted in the carriage with the ejection head. The liquid supplied from the third liquid container to the ejection head is performed by using the hydraulic head differential through the pressure regulator.

The pressure regulator regulates the supply pressure of the liquid to be supplied to the ejection head so that a pressure applied for the liquid supply to a liquid chamber of the ejection head is lower than the atmospheric pressure. An example of the pressure regulator may be a mechanical pressure damper, which may be selected from suitable ones of the known mechanical pressure dampers that regulate negative pressure using the hydraulic head differential.

Some known inkjet recording apparatuses (known inkjet printers) are equipped with a mechanical pressure damper that regulates negative pressure using the hydraulic head differential. Such apparatuses may be directly used without any structural change and supplied with the liquid from the liquid supply apparatus. When an inkjet recording apparatus is used that has such a mechanical pressure damper, the hydraulic head differential may be used for the liquid supply throughout the whole liquid supply path from the first liquid container of the liquid supply apparatus to the ejection head of the inkjet recording apparatus. Thus, an electric pressure damper or a feed pump may be dispensed with in a system including the liquid supply apparatus and the inkjet recording apparatus. This may lead to reduced apparatus costs, and may also eliminate the risk of possible trouble with the liquid supply due to the breakdown of an electrical system.

[Configuration 4]

The liquid supply apparatus further has a checking device configured to check a liquid amount in the first liquid container. An example of the checking device may be a liquid amount detecting sensor that detects a liquid amount in the first liquid container. The checking device may be a window that allows the liquid amount to be checked by an operator.

An operator may accordingly know the liquid amount supplied from the second liquid container. Due management of the liquid amount may ensure constant and reliable liquid supply to the first liquid container without the risk of overflow. Further providing the checking device may allow the liquid to be supplied in an exactly required amount during, for example, a long-hour operation.

[Configuration 5]

The second liquid container has a liquid capacity smaller than a liquid capacity of the first liquid container. The liquid capacity of a container means a maximum amount of liquid containable in the container.

The replaceable second liquid container thus smaller than the first liquid container may be easily handled by an operator without damage to his/her back. Thus, the second liquid container may be readily replaceable, and the replacement work may become less of a burden for an operator. The second liquid container thus downsized may be better adapted for replacement.

[Configuration 6]

The liquid supply apparatus further has a liquid feeder that feeds the liquid from the second liquid container to the first liquid container. The second liquid container is disposed at a lower position in the gravitational direction than the first liquid container.

Disposing the first liquid container at an upper position than the other container may ensure smooth and sufficient supply of the liquid by the hydraulic head differential. The replaceable second liquid container disposed at a lower position than the other container may be easily handled and readily replaceable, and the replacement work may become less of a burden for an operator. The second liquid container thus positioned may be better adapted for replacement.

An example of the liquid feeder may be a pump. The liquid supply apparatus may further have a liquid amount detecting sensor that detects a liquid amount in the first liquid container. With such a sensor, the liquid amount from the second liquid container may be checked whenever necessary, and the liquid supply from the second liquid container to the first liquid container may be properly manageable.

The liquid feeder, for example, a pump, may be disposed in a flow path of the liquid from the second liquid container to the first liquid container. The flow path may be provided with a valve that opens in response to a timing of liquid feed by the liquid feeder. Such a liquid feeder may prevent backflow of the liquid supplied from the first liquid container to the second liquid container and may allow for smooth liquid flow from the second liquid container to the first liquid container.

[Configuration 7]

The second liquid container is disposed at an upper position in a gravitational direction than the first liquid container. The liquid is supplied from the second liquid container to the first liquid container by using the hydraulic head differential generated by a difference between positions of the first and second liquid containers.

This configuration may ensure smooth and sufficient supply of the liquid from the second liquid container to the first liquid container, and may fully utilize the dual-container structure composed of the first and second liquid containers.

[Configuration 8]

The second liquid container is inclined longitudinally relative to the gravitational direction and held by the replaceable container holder. In this configuration, the second liquid container may supply the liquid to the first liquid container through a supply port located in the vicinity of a lowermost part of the second liquid container in the gravitational direction.

This configuration may adequately suppress any difference of the liquid level in the second liquid container, and may thereby minimize variability of the hydraulic head differential that may occur during continuous supply of the liquid. Thus, the first liquid container may still receive the liquid from the second liquid container in which the liquid amount has fallen. This may promise smooth and adequate supply of the liquid from the second liquid container to the first liquid container.

[Configuration 9]

A liquid previously degassed is containable in the second liquid container, and the liquid is supplied from the second liquid container to the ejection head without exposure to air. This configuration may allow the liquid droplets to be smoothly ejected from the ejection head without the need to provide a degassing configuration (for example, degassing module) in the liquid supply path. This may adequately suppress any increase in apparatus costs.

[Configuration 10]

The first liquid container has a capacity variable in response to an amount of the liquid currently contained inside. An example of the first liquid container thus characterized may be a container in the form of a pack.

The liquid may be containable without exposure to air in the first liquid container thus variable in capacity. The liquid amount in the first liquid container is variable with the liquid supply from the second liquid container and/or the liquid supply to the ejection head. Yet, the liquid, regardless of its changing amount, may stay out of contact with air. A previously degassed liquid, if used as the liquid to be supplied, may avoid exposure to air.

[Configurations 11 and 12]

The second liquid container has a capacity variable in response to an amount of the liquid currently contained inside. An example of the second liquid container thus characterized may be a container in the form of a pack.

The liquid may be containable without exposure to air in the second liquid container thus variable in capacity. The liquid amount in the second liquid container is variable with the liquid supply to the first liquid container. Yet, the liquid, regardless of its changing amount, may stay out of contact with air. A previously degassed liquid, if used as the liquid to be supplied, may avoid exposure to air.

[Configuration 13]

The ejection head has a nozzle through which the droplets are ejected, and a liquid chamber in which the liquid is containable at a position preceding the nozzle. The ejection head receives the liquid supplied from the first liquid container through the pressure regulator that regulates a supply pressure of the liquid to be supplied to the ejection head. The pressure regulator regulates the supply pressure of the liquid to be supplied to the ejection head so that a pressure applied for a liquid supply to the liquid chamber of the ejection head is lower than atmospheric pressure.

This configuration may ensure smooth and sufficient supply of the liquid using the hydraulic head differential. An example of the pressure regulator may be a mechanical pressure damper. The pressure regulator may be disposed at a position in the vicinity of the ejection head. When a carriage is provided as a holder for the ejection head, the pressure regulator may be mounted in the carriage with the ejection head.

[Configuration 14]

This invention further provides a liquid supply method for supplying a liquid to an ejection head of an inkjet recording apparatus. The ejection head ejects the liquid in the form of droplets using inkjet scheme. The liquid supply method includes: disposing a first liquid container at a position at which the liquid in the first liquid container is suppliable to the inkjet recording apparatus by a hydraulic head differential; and replaceably holding a second liquid container provided apart from the first liquid container. The liquid to be supplied to the first liquid container is containable in the second liquid container at a position preceding the first liquid container. The liquid that the first liquid container receives from the second liquid container is supplied to the inkjet recording apparatus under a pressure generated by the hydraulic head differential. The method according to this configuration may produce effects similar to the configuration 1.

[Configuration 15]

This invention further provides a liquid ejection system configured to eject a liquid in the form of droplets using inkjet scheme. The liquid ejection system includes an inkjet recording apparatus having an ejection head that ejects the droplets using the inkjet scheme. The system further includes: a first liquid container disposed at a position at which the liquid in the first liquid container is suppliable to the inkjet recording apparatus by a hydraulic head differential; and a replaceable container holder that replaceably holds a second liquid container provided apart from the first liquid container. The liquid to be supplied to the first liquid container is containable in the second liquid container at a position preceding the first liquid container. The liquid that the first liquid container receives from the second liquid container is supplied to the inkjet recording apparatus under a pressure generated by the hydraulic head differential. The method according to this configuration may produce effects similar to the configuration 1.

Advantageous Effects of Invention

According to this invention, the liquid supply to the ejection head may be constantly and reliably performed.

BRIEF DESCRIPTION OF THE DRAWINGS

FIG. 1A and FIG. 1B are drawings of a printing system 10 according to an embodiment of this invention. FIG. 1A is a drawing of the printing system 10. FIG. 1B is a table showing locations of sensors and events detected by the sensors according to the embodiment.

FIG. 2A is a drawing of a printing system 10 according to the first modified embodiment. FIG. 2B is a drawing of a non-replaceable ink pack 202 and a replaceable ink pack 204 that are longitudinally disposed on each other along the vertical direction.

FIGS. 4A to 4C are graphic charts of examples of different magnitude relations among liquid capacities X, Y, and Z of the replaceable ink pack 204, non-replaceable ink pack 202, and intermediate ink pack 212.

FIG. 5 is a table showing uninterrupted ejection time in each of the examples illustrated in FIGS. 4A to 4C.

FIG. 6A and FIG. 6B are drawings of stages of ink decrease and warnings issued correspondingly to the stages. FIG. 6A is a drawing of a relationship between the stages and timings of issuing the warnings. FIG. 6B is a table showing events detected at different timings.

DESCRIPTION OF EMBODIMENT

Figure 2A:
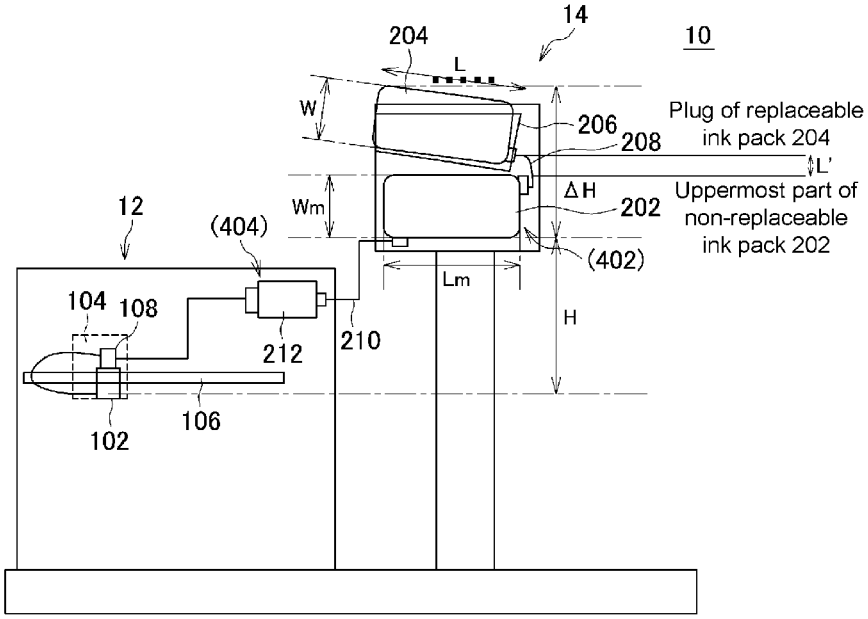
FIG. 2A and FIG. 2B are drawings of a first modified embodiment of the printing system 10.

Hereinafter, embodiments of this invention are described in detail with reference to the accompanying drawings. FIG. 1A and FIG. 1B are drawings of a printing system 10 according to an embodiment of this invention. FIG. 1A is a drawing of the printing system 10. The printing system 10 according to this embodiment is an inkjet printing system. This system includes a printer 12 and an ink supply apparatus 14.

FIG. 1A and FIG. 1B illustrate one inkjet head 102 to simplify the illustration. The printer 12 that uses a plurality of color inks may have a plurality of inkjet heads 102. The inkjet head 102 performs main scans to print an object on a medium. In each main scan, the inkjet head 102 ejects ink droplets, moving in a preset main scanning direction.

The printing system 10 may be a liquid ejection system configured to eject from an ejection head a liquid in the form of droplets using the inkjet scheme. The printer 12 may be a liquid ejection apparatus with an ejection head. The ink supply apparatus 14 is an example of the liquid supply apparatus that supplies a liquid to an ejection head.

Except for the technical features hereinafter described, the printing system 10, printer 12, and ink supply apparatus 14 may be structured and characterized similarly or identically to the known printing systems, inkjet printers, and ink supply apparatuses. In addition to the technical features hereinafter described, the printing system 10, printer 12, and ink supply apparatus 14 may further include other features that are similar or identical to the features of the inkjet printers, and ink supply apparatuses. Examples of the known ink supply apparatuses may include ink feeders (MBIS: Mimaki Bulk Ink System) developed for ink supply to inkjet printers manufactured by MIMAKI ENGINEERING CO., LTD.

The description of this embodiment starts with an exemplified structure of the printer 12 in the printing system 10. The printer 12 is an inkjet printer that performs inkjet printing. This printer has an inkjet head 102, a carriage 104, a guide rail 106, and a pressure damper 108. In this embodiment, the printer 12 is an example of the inkjet recording apparatus.

The inkjet head 102 is an example of the ejection head and ejects droplets of ink, i.e., liquid, using the inkjet scheme to print objects on various types of media. The inkjet head 102 has a nozzle through which the ink droplets are ejected, and a liquid (ink) chamber in which the liquid is containable at a position preceding the nozzles. The nozzles and the liquid chamber may be similar to or identical to the nozzles and the liquid chambers of the known inkjet heads. The inkjet head 102 may have a nozzle array having a plurality of nozzles aligned in a predetermined direction. The inkjet head 102 with the plural nozzles may have a plurality of liquid chambers provided correspondingly to the nozzles. In this embodiment, the inkjet head 102 receives ink from the ink supply apparatus 14 through the pressure damper 108.

Any suitable one of the known inks may be used in the inkjet head 102. A print target medium may be selected from the known media. The printer 12 may further include any configurations suitably adapted for the ink and/or medium used for printing.

FIG. 1 illustrates one inkjet head 102 to simplify the illustration. The printer 12 that uses a plurality of color inks may have a plurality of inkjet heads 102. The inkjet head 102 performs main scans to print an object on a medium. In each main scan, the inkjet head 102 ejects ink droplets, moving in a preset main scanning direction.

The carriage 104 is a holder in which the inkjet head 102 is mounted and held so as to face the medium. In this embodiment, the pressure damper 108, as well as the inkjet head 102, is mounted in the carriage 104. The carriage 104 mounted with the inkjet head 102 moves in the main scanning direction to have the inkjet head 102 perform main scans. The guide rail 106 guides the movement of the carriage 104 in the main scanning direction.

The pressure damper 108 is an example of the pressure regulator that regulates the supply pressure of ink to be supplied to the inkjet head 102. In this embodiment, the pressure damper 108 is mounted in the carriage 104 with the inkjet head 102 in the vicinity of the inkjet head 102. The pressure damper 108 thus located regulates the supply pressure at a position immediately before the inkjet head 102. The pressure damper 108 specifically regulates the supply pressure of ink to be supplied to the inkjet head 102 so that a pressure applied for the liquid supply to the liquid chamber of the inkjet head 102 is lower than the atmospheric pressure (negative pressure).

The pressure damper 108 may be selected from the known pressure dampers. An example of the pressure damper 108 may be a mechanical pressure damper. The mechanical pressure damper mechanically regulates pressure without having to use, for example, a pressure regulating pump. The mechanical pressure damper may be structured such that a thin film disposed in contact with an ink flow path is biased by a biasing member, e.g., spring.

In this embodiment, the printer 12 may have plural inkjet heads 102, as described earlier. In this instance, the printer 12 may have a plurality of pressure dampers 108 correspondingly to the inkjet heads 102. According to this structure, ink may be supplied to the inkjet head 102 under a well-controlled supply pressure. This may improve the printing performance of the printer 12 using the inkjet head 102.

As described later in further detail, the inkjet head 102 in this embodiment is supplied with ink from the ink supply apparatus 14 by hydraulic head differential illustrated in the drawing. To this end, the printer 12 has an ink supply path in addition to the structural elements described so far. The inkjet head 102 is supplied with ink from the ink supply apparatus 14 through this supply path in which such a device as a pump is unused. In this embodiment, the printer 12 receives previously degassed ink from the ink supply apparatus 14. In the printer 12, therefore, a degassing device, for example, a degassing module, may be unnecessary for the ink supply from the ink supply apparatus 14 to the inkjet head 102.

In this embodiment, the printer 12 receives the previously degassed ink from the ink supply apparatus 14, and the received degassed ink is delivered to the ejection head by hydraulic head differential. This may structurally simplify the printer 12, leading to cost reduction of the printer 12.

An exemplified structure of the ink supply apparatus 14 is hereinafter described. The ink supply apparatus 14 is coupled to an ink supply unit leading to the inkjet head 102 of the printer 12 to supply the inkjet head 102 with the ink. In this embodiment, the ink supply apparatus 14 may have a non-replaceable ink pack 202, a replaceable ink pack 204, a replaceable pack holder 206, an ink flow path 208, an ink flow path 210, and an intermediate ink pack 212. As illustrated in the drawing, the ink supply apparatus 14 may have a plurality of ink packs, holders, and ink flow paths, in which case the ink supply apparatus 14 may have a respective one of the ink packs, holders, and ink flow paths for each of ink supply paths. The ink is supplied to one inkjet head 102 of the printer 12 through each of the ink supply paths.

To simplify the description, the ink supply apparatus 14 is hereinafter described with a focus on one ink supply path, though the other ink supply paths are similar or identical to the described one.

The non-replaceable ink pack 202 is an example of the first liquid container. The non-replaceable ink pack 202 is a stationary, non-replaceable container provided in the ink supply apparatus 14. The ink to be supplied to the printer 12 is supplied to and stored in this ink pack. The non-replaceable ink pack 202; ink container, is securely disposed in the ink supply apparatus 14, specifically, immovably secured to a position in the ink supply apparatus 14 (stationary container). The non-replaceable ink pack 202 may be constantly filled with the ink from another container.

The non-replaceable ink pack 202 is disposed at an upper position in the gravitational direction than the inkjet head 102 of the printer 12, at which the liquid in this pack is suppliable to the inkjet head 102 by hydraulic head differential. From the non-replaceable ink pack 202 thus positioned is supplied the ink to the inkjet head 102 by hydraulic head differential.

The non-replaceable ink pack 202 may be disposed at an upper position in the gravitational direction than the nozzle surface of the inkjet head 102. The nozzle surface of the inkjet head 102 is a surface of the inkjet head 102 where the nozzles are formed. The non-replaceable ink pack 202 may be disposed at an upper position than the inkjet head 102 by several tens of centimeters or more (by 10 cm or more or by 50 cm or more).

In this embodiment, the non-replaceable ink pack 202 has a capacity (container's volume) variable in response to an amount of liquid currently contained inside. The ink may be containable without exposure to air in the non-replaceable ink pack 202 thus variable in capacity. The ink capacity of the non-replaceable ink pack 202 may be variable. Yet, the ink may stay out of contact with air. The non-replaceable ink pack 202 may be selected from packs made of flexible materials and structurally flexible packs such as pleated bellows-like packs. As illustrated in the drawing, the non-replaceable ink pack 202 may include a bag-like portion in which the ink is containable, and a case in which the bag-like portion is housed. A specific example of the non-replaceable ink pack 202 may be an ink pack rectangular in cross section.

The non-replaceable ink pack 202 has an ink outlet leading to the printer 12, and an ink inlet leading to the replaceable ink pack 204 (liquid supply unit, supply port). The ink outlet is coupled to the intermediate ink pack 212 with the ink flow path 210. Then, the ink flows out of the non-replaceable ink pack 202 into the printer 12 through the ink flow path 210. The ink inlet of the non-replaceable ink pack 202 is coupled to the replaceable ink pack 204 with the ink flow path 208.

In this embodiment, the non-replaceable ink pack 202 has a sensor 402 that detects an ink capacity of the non-replaceable ink pack 202. To simplify the illustration, the reference symbol of the sensor 402 alone is illustrated in the drawing instead of the sensor's specific shape. The operation of the sensor 402 will be described later in further detail.

In this embodiment, the non-replaceable ink pack 202 supplies the ink to the inkjet head 102 through the intermediate ink pack 212 and the pressure damper 108. The non-replaceable ink pack 202 may be disposed at an upper position in the gravitational direction than the intermediate ink pack 212. In this instance, the hydraulic head differential used for the ink supply may be specifically a hydraulic head differential corresponding to a difference between the liquid level in the non-replaceable ink pack 202 and the position of the pressure damper 108.

The replaceable ink pack 204 is an example of the second liquid container, which is provided apart from the non-replaceable ink pack 202. The ink to be supplied to the non-replaceable ink pack 202 through the ink flow path 208 is containable in the replaceable ink pack 204 at a position preceding the non-replaceable ink pack 202. In this embodiment, the replaceable ink pack 204 is disposed at a lower position in the gravitational direction than the non-replaceable ink pack 202. The replaceable ink pack 204 may be disposed at a lower position than the inkjet head 102 of the printer 12 in the gravitational direction. Specifically, the replaceable ink pack 204 may be disposed at a lower position than the nozzle surface of the inkjet head 102.

In this embodiment, the replaceable ink pack 204 has a capacity (container's volume) variable in response to an amount of liquid currently contained inside, similarly to the non-replaceable ink pack 202. The ink may be containable without exposure to air in the replaceable ink pack 204 thus variable in capacity. The ink capacity of the non-replaceable ink pack 202 may be variable. Yet, the ink may stay out of contact with air. The replaceable ink pack 204 may be selected from packs made of flexible materials and structurally flexible packs such as pleated bellows-like packs. Similar to the non-replaceable ink pack 202, the replaceable ink pack 204 may have a bag-like portion and a casing. A specific example of the replaceable ink pack 204 may be an ink pack rectangular in cross section.

In this embodiment, the replaceable ink pack 204 is filled with the previously degassed ink. The replaceable ink pack 204 containing the degassed ink is loaded in the ink supply apparatus 14. The replaceable ink pack 204 has an ink outlet leading to the non-replaceable ink pack 202. Through this outlet, the ink travels through the ink flow path 208 into the non-replaceable ink pack 202. In this embodiment, the replaceable ink pack 204 is replaceably held by a replaceable pack holder 206.

The replaceable pack holder 206 is an example of the replaceable container holder and holds the replaceable ink pack 204 in a replaceable manner. The replaceable pack holder 206 may be a table on which the replaceable ink pack 204 is mounted and supported. The replaceable pack holder 206 holds the replaceable ink pack 204, with its ink outlet being directed upward. The replaceable pack holder 206 and the replaceable ink pack 204 thereby held may be removable together from the body of the ink supply apparatus 14. In this instance, the replaceable pack holder 206 may be a carriage-like holder mounted with the replaceable ink pack 204 having a large capacity.

The ink flow path 208 is an ink flow path for the ink from the replaceable ink pack 204 to flow into the non-replaceable ink pack 202. In this embodiment, the ink flow path 208 has a pump 302 and a valve 304. The pump 302 is an example of the liquid feeder that urges the ink to flow out of the replaceable ink pack 204 into the non-replaceable ink pack 202. The pumping action may promise smooth supply of the ink to the non-replaceable ink pack 202 located at a vertically upper position than the replaceable ink pack 204. The pump 302 may be a pump that allows no contact of the ink with air when feeding the ink. A specific example of the pump 302 may be a tubing pump.

The valve 304 opens and closes in conjunction with the pump 302. The valve 304 opens at timings of feed of the ink using the pump 302 and is kept closed otherwise. The valve 304 may open almost simultaneously when the pump 302 starts to operate. The valve 304 may close almost simultaneously when the pump 302 ceases to operate.

This may prevent backflow of the ink from the non-replaceable ink pack 202 to the replaceable ink pack 204, allowing the ink to smoothly flow out of the replaceable ink pack 204 into the non-replaceable ink pack 202. Then, the non-replaceable ink pack 202 may keep the hydraulic head differential more stable.

The ink flows into the non-replaceable ink pack 202 and travels through the ink flow path 210 into the printer 12. In this embodiment, the ink outlet of the non-replaceable ink pack 202 is coupled to the intermediate ink pack 212 with the ink flow path 210, so that the ink from the non-replaceable ink pack 202 flows into the intermediate ink pack 212.

The intermediate ink pack 212 is an attachment mounted in the printer 12. The printer 12 and the non-replaceable ink pack 202 are coupled to each other with the intermediate ink pack 212 through the ink flow path 210, so that the ink from the non-replaceable ink pack 202 flows into the printer 12.

In this embodiment, the intermediate ink pack 212 has a sensor 404 that detects an ink capacity of the intermediate ink pack 212. To simplify the illustration, the reference symbol of the sensor 404 alone is illustrated in the drawing instead of the sensor's specific shape. The operation of the sensor 404 will be described later in further detail.

The intermediate ink pack 212 may be regarded as a second non-replaceable ink pack (non-replaceable intermediate ink pack) loaded in the printer 12. The intermediate ink pack 212 is specifically an attachment mounted in the printer 12 in place of an ink cartridge to externally supply the printer 12 with the ink. The ink cartridge is a replaceable, small-sized ink container, and may be selected from the known ink cartridges. In this embodiment, the printer 12 is operable to perform printing using either one of the ink cartridge or the intermediate ink pack 212.

The intermediate ink pack 212 may be considered to be a component of the printer 12 instead of the ink supply apparatus 14, or the intermediate ink pack 212 may be considered to be an independent member apart from the printer 12 and the ink supply apparatus 14.

By locating the non-replaceable ink pack 202 at an upper position than the inkjet head 102, low-cost ink supply to the inkjet head 102 may be feasible by the hydraulic head differential. A practical use of the ink supply using the hydraulic head differential may be a large-capacity ink supply system with non-replaceable ink packs 202 and replaceable ink packs 204 that are serially intercoupled in multiple stages. In such a system may be used the replaceably-supported ink packs 204 that are structured or arranged to be readily replaceable. In this embodiment, the replaceable ink pack 204 is disposed at a lower position than the non-replaceable ink pack 202. An operator may replace the replaceable ink pack 204 thus positioned without the labor of uplifting it.

Thus, the replaceable ink pack 204 may be easily handled and readily replaceable, and the replacement work may become less of a burden for an operator. These structural features may facilitate replacement of the containers for the ink supply.

In the system described earlier, its large storage capacity is divided into the non-replaceable ink packs 202 and replaceable ink packs 204 that are intercoupled in multiple stages. When this system is continuously operated, therefore, any one of the replaceable ink packs 204 may be replaceable, whenever necessary, during the ongoing ink supply from the non-replaceable ink packs 202 to the inkjet head 102. The printer 12, if uninterruptedly operated for long hours, may continue to be supplied with the ink during the operation. This may be an effective advantage for long-hour, uninterrupted printing operations.

In this embodiment, as described earlier, a previously degassed ink is used in the ink supply apparatus 14 and the printer 12, and is supplied from the replaceable ink pack 204 to the inkjet head 102 without exposure to air. No degassing configuration (for example, degassing module), therefore, needs to be provided in the ink supply path to avoid possible problems such as poor ink output. Without such additional configuration, the ink may be smoothly ejected from the inkjet head 102. This may adequately suppress any increase in apparatus costs.

The ink supply without exposure to air means the ink supply without an intention to expose the ink to the atmosphere. The ink supply without exposure to air may mean the ink supply configured to avoid exposure to air in design. In practical use, the ink supply without exposure to air may mean the supply of a previously degassed ink without the need to provide a degassing configuration in the ink supply path.

The previously degassed ink may be an ink from which dissolved gas (for example, dissolved oxygen) has been removed to at least an extent that poor ink output from the inkjet head 102 may be prevented. In practical use, the previously degassed ink may be an ink degassed to at least a similar extent to the known degassed inks. The previously degassed ink may be an ink previously degassed in, for example, a factory in which the ink was manufactured.

In this embodiment, the replaceable ink pack 204 may be disposed at a vertically lower position without regard to use of hydraulic head differential for the ink supply. The replaceable ink pack 204 may be a container with an adequately large capacity, as required, of approximately 2 L to 20 L (large-capacity pack). The replaceable ink pack 204 may have a larger liquid capacity than the non-replaceable ink pack 202 with a relatively small capacity. As for ink containers such as the non-replaceable ink pack 202 and the replaceable ink pack 204, the liquid capacity indicates a maximum amount of liquid containable in the container. The replaceable ink pack 204 thus increased in capacity may be replaced with another ink pack less frequently. Specifically, the replaceable ink pack 204 may have a liquid capacity 1.5 times or more of the liquid capacity of the non-replaceable ink pack 202.

The non-replaceable ink pack 202, for which replacement is unnecessary, may be a container with a sufficiently large capacity as required. The non-replaceable ink pack 202 may have a liquid capacity greater than or equal to 2 L. For certain specs required of the apparatus, the liquid capacity of the replaceable ink pack 204 may be smaller than the liquid capacity of the non-replaceable ink pack 202.

In this embodiment, the non-replaceable intermediate ink pack 212 is interposed between the non-replaceable ink pack 202 and the inkjet head 102. This may further ensure stability of the ink supply to the inkjet head 102. The intermediate ink pack 212 may have a liquid capacity greater than or equal to 2 L (approximately, 2 L to 3 L).

So far was described the ink supply to the inkjet head 102. The ink is a non-limiting example of the liquid supplied to the inkjet head 102. Other examples of the liquid may include a cleaning liquid. In this instance, the non-replaceable ink pack 202 and the replaceable ink pack 204 are supplied with a cleaning liquid instead of ink. Other examples of the liquid may further include functional liquids, in which case the inkjet head 102 may be replaced with an ejection head suitable for any functional liquid used.

In the ink supply described so far is used the ink supply apparatus 14 separately from the printer 12. In a modified embodiment of the printing system 10, the ink may be supplied from the replaceable ink pack 204 to the inkjet head 102 of an inkjet printer functionally similar or identical to the printer 12 and the ink supply apparatus 14 described referring to FIG. 1A and FIG. 1B.

The sensors 402 and 404 of the non-replaceable ink pack 202 and the intermediate ink pack 212 are hereinafter described in further detail. FIG. 1B is a table showing locations of sensors and events detected by the sensors in this embodiment.

As described so far, the ink containers used in this embodiment are the replaceable ink pack 204, non-replaceable ink pack 202, and intermediate ink pack 212. Among these ink packs, the replaceable ink pack 204 alone is not equipped with an ink amount detecting sensor, because of desirable cost reduction of the replaceable ink pack 204 that is a replaceable and disposable item when the ink runs out.

However, the replaceable ink pack 204 may be equipped with a sensor that detects any decrease of the ink at a halfway point, for example, an ink amount after reduction to a half or by 70%. With such a sensor, the ink supply may be properly manageable, in which, however, detection of ink depletion (end detection) may be unnecessary.

The non-replaceable ink pack 202 and the intermediate ink pack 212 respectively have the sensor 402 and the sensor 404. The sensors 402 and 404 may allow the ink supply to be performed without having to detect any residual ink in the replaceable ink pack 204.

The sensor 402 is an example of the checking device to check the ink capacity in the non-replaceable ink pack 202. This is specifically a liquid amount detecting sensor that detects the ink capacity in the non-replaceable ink pack 202. The sensor 402 may be equipped to detect when the ink starts to decrease in the non-replaceable ink pack 202 in an early stage of decrease.

The sensor 402 may be equipped to detect an ink decrease at a halfway point, for example, an ink amount after reduction to a half or by 70%. The end detection is not required of the sensor 402 either. The sensor 404 provided in the intermediate ink pack 212 may detect that the non-replaceable ink pack 202 is empty. Therefore, the end detection by the sensor 402 of the non-replaceable ink pack 202 may be unnecessary. In this embodiment, the sensor 402 detects, at least, a volume (ink capacity) of the non-replaceable ink pack 202 being equal to or less than a predetermined amount (detection A), and the non-replaceable ink pack 202 being almost full to capacity (detection B).

In this embodiment, the sensor 404 provided in the intermediate ink pack 212 is a liquid amount detecting sensor that detects the ink capacity of the intermediate ink pack 212. The sensor 404 may be equipped to detect when the ink starts to decrease in the intermediate ink pack 212 in an early stage of decrease. The sensor 404 may be equipped to detect an ink decrease at a halfway point, for example, an ink amount after reduction to a half or by 70%. The end detection may be required of the sensor 404. In this embodiment, the sensor 404 detects, at least, when the volume (ink capacity) of the intermediate ink pack 212 starts to decrease (detection C), the intermediate ink pack 212 being almost full to capacity (detection D), and depletion of the ink in the intermediate ink pack 212 (detection E).

An example of the sensors 402, 404 may be a liquid amount detecting sensor that detects the ink capacity of the non-replaceable ink pack 202, intermediate ink pack 212. Examples of the liquid amount detecting sensor may include liquid level sensors and weight sensors. These examples of the liquid amount detecting sensor may include non-contact sensors and contact sensors. The sensors 402 and 404 may detect the liquid amounts in the respective ink packs by optically detecting changes in volume of the ink packs or by detecting changes in weight of the ink packs.

Any other suitable device but the sensor may be employed to check the ink capacities of the respective ink packs. The checking device may be a window that allows the ink amounts in these ink packs to be checked by an operator.

Next, detection by the sensors 402, 404 of the ink amount and an operation of the ink supply apparatus 14 in accordance with the detection are hereinafter described. When the residual ink level falls low in the non-replaceable ink pack 202, the detection A is detected by the sensor 402. As a result of the detection A, the ink supply apparatus 14 feeds the ink from the replaceable ink pack 204 into the non-replaceable ink pack 202 using the pump 302 to supply the non-replaceable ink pack 202 with the ink. The ink in the non-replaceable ink pack 202 accordingly increases, and the non-replaceable ink pack 202 expands to a certain volume. At this point, the detection B is detected by the sensor 402. As a result of the detection B, the ink supply apparatus 14 deactivates the pump 302. At this point, the non-replaceable ink pack 202 is filled up with the ink.

In case the detection B is not detected after the pump 302 is driven over a certain period of time, the ink supply apparatus 14 determines that the replaceable ink pack 204 is empty. Thus, the sensor 402 of the non-replaceable ink pack 202 detects that the preceding replaceable ink pack 204 is empty. When the sensor 402 detects that the replaceable ink pack 204 is empty, an operator may be notified of the detection result by, for example, a warning, requesting replacement of the replaceable ink pack 204.

When the residual ink level starts to fall in the intermediate ink pack 212, the detection C is detected by the sensor 404. This indicates there is no longer the ink supply from the non-replaceable ink pack 202, in which case a warning, for example, may be issued to notify an operator of the non-replaceable ink pack 202 being empty. As in the detection A by the sensor 402, the pump 302 may be driven to supply the ink from the replaceable ink pack 204 to the non-replaceable ink pack 202.

By continuing the ink supply until the intermediate ink pack 212 expands to a certain volume, resulting in the detection D, the non-replaceable ink pack 202 and the intermediate ink pack 212 may be filled with the ink. In case the detection C is still valid, with the detection D undetected after the pump is driven for a certain time, the non-replaceable ink pack 202 and the replaceable ink pack 204 preceding the intermediate ink pack 212 may be determined as empty. In that case, a warning, for example, may be issued to notify an operator of the situation.

When the ink runs out in the intermediate ink pack 212, the detection E is detected by the sensor 404. This indicates that all of the intermediate ink pack 212, non-replaceable ink pack 202, and replaceable ink pack 204 have been emptied. This may result in emergency shutdown of the ink supply apparatus 14 and the printer 12. A warning, for example, may be issued likewise to notify an operator of the shutdown.

Thus, current statuses of the respective ink packs may be detected by the sensors 402 and 404 of the non-replaceable ink pack 202 and the intermediate ink pack 212. By detecting the multiple statuses of the ink packs and notifying an operator of the results by issuing, for example, a warning, the ink supply may be more reliably and smoothly performed.

In this embodiment, an amount of ink from the replaceable ink pack 204 to the non-replaceable ink pack 202 may be properly checked. Due management of the liquid amount may ensure constant and reliable ink supply to the non-replaceable ink pack 202 without the risk of overflow. Further, the ink supply from the non-replaceable ink pack 202 to the intermediate ink pack 212 may also be properly manageable. This embodiment may allow the ink to be supplied in an exactly required amount during, for example, a long-hour operation of the printing system 10.

During the ink supply from the replaceable ink pack 204 to the non-replaceable ink pack 202 using the pump 302, an amount of ink supplied to the non-replaceable ink pack 202 may be detected by the sensor 402. Under such a closed loop control, the pump 302 may be automatically deactivated to prevent oversupply of the ink when, for example, an operator involved in another task has to leave the apparatus for prolonged time. This embodiment, therefore, may ensure safety during a long-hour operation of the printing system 10.

Apart from what is described in this embodiment, a pump-driven direct supply of ink to an attachment, like the intermediate ink pack 212, may be a possible option for external ink supply to the printer 12. To optimally control the pump, however, an additional sensor may be necessary in the ink flow path of a closed loop to control an amount of ink pumped to flow. Unless the printer 12 has a sensor at the ink cartridge position, an additional sensor may be necessary. Therefore, the ink supply from an external source is not possible with the known inkjet printers if they are directly used. The ink supply apparatus 14 according to this embodiment, on the other hand, may be structured to successfully supply ink externally to the known inkjet printers that are directly used.

Conventionally, ink bottles may be used to supply printers with a large amount of ink. However, degassed inks may be unusable in such bottle-used methods because exposure to air may be unavoidable. To stabilize ejection of ink from an inkjet head, a degassing device including a hollow fiber filter and a depressurizing pump should be provided in an ink flow path to the inkjet head. This, however, raises other potential issues with apparatuses, for example, cost and size increases. In this embodiment, the non-replaceable ink packs 202 and the replaceable ink packs 204 are used in which the ink is containable without exposure to air, and these ink packs are arranged and intercoupled in multiple stages. This embodiment, without using a degassing device in the printer 12, may successfully supply the printer 12 with a large amount of ink at low cost.

Figure 2B:
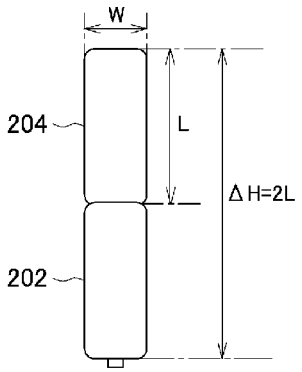

Modified embodiments of the printing system 10 are hereinafter described. FIG. 2A and FIG. 2B are drawings of a first modified embodiment of the printing system 10. FIG. 2A is a drawing of a printing system 10 according to the first modified embodiment. Except for the additional features described below, the structural elements illustrated in FIG. 2A and FIG. 2B with the same reference signs as FIG. 1A and FIG. 1B are identical or similar to those illustrated in FIG. 1A and FIG. 1B. A printer 12 according to this modified embodiment may be the same inkjet printer 12 as described earlier referring to FIG. 1A and FIG. 1B.

In an ink supply apparatus 14 hereinafter described, the replaceable ink pack 204 is located differently from the ink supply apparatus 14 of FIG. 1A and FIG. 1B. In this modified embodiment, the replaceable ink pack 204 is disposed at an upper position in the gravitational direction than the non-replaceable ink pack 202. As a result of this change, the replaceable pack holder 206 and the ink supply from the replaceable ink pack 204 to the non-replaceable ink pack 202 are configured differently from the ink supply apparatus 14 of FIG. 1A and FIG. 1B.

In this modified embodiment, the replaceable ink pack 204 is disposed at an upper position than the non-replaceable ink pack 202. The ink supply from the replaceable ink pack 204 to the non-replaceable ink pack 202, therefore, does not rely upon the pump 302 (see FIG. 1A and FIG. 1B) but is induced by a hydraulic head differential resulting from a difference between positions of the replaceable ink pack 204 and the non-replaceable ink pack 202. In the apparatus thus characterized, the non-replaceable ink pack 202 may be gravitationally and automatically filled with the ink. This may lead to cost reduction of the apparatus.

In this modified embodiment, the non-replaceable ink pack 202 and the replaceable ink pack 204 are coupled to each other with an ink flow path such as a tube. The ink outlet of the replaceable ink pack 204 has a spout. The tube has, at an end part thereof, a joint connected to the spout. The flow path may desirably have an adequately large diameter at intercoupled parts of the spout and the joint to reduce any flow resistance in the flow path. To be specific, the flow path may desirably have at least a diameter large enough to prevent any flow resistance in the flow path generated between the non-replaceable ink pack 202 and the replaceable ink pack 204 from affecting the hydraulic head differential (mean hydraulic head differential) for the ink supply to the inkjet head 102.

The non-replaceable ink pack 202 and the replaceable ink pack 204 may be coupled to each other in a manner that any leakage of the ink is prevented when these ink packs are decoupled. The spout of the replaceable ink pack 204 may be structured to block the ink flow path when the ink packs are decoupled, or a valve disposed in the ink flow path may be closed to block this flow path when the ink packs are decoupled. Other possible configurations may include a dual valve, and an automatic on-off valve for the flow path. Any one of these configurations may prevent leakage of the ink when the ink packs are decoupled. Such configurations may also prevent that air is drawn into the non-replaceable ink pack 202 closer to the inkjet head 102.

A specific configuration for coupling the non-replaceable ink pack 202 and the replaceable ink pack 204 may be a plug with an automatic on-off valve, as in plastic bottles. A leakage-preventing plug may be attached to a pack (replaceable ink pack 204)-side position in the apparatus, and a push-in holder engageable with the plug may be attached to a body-side position in the apparatus leading to the non-replaceable ink pack 202. The holder may be provided in the replaceable pack holder 206. The push-in holder may be equipped with a latching mechanism by which the ink pack-side plug is latched at a given position. The push-in holder may have a plug on the body side to prevent drawn-in of air.

Other possible configurations for coupling the non-replaceable ink pack 202 and the replaceable ink pack 204 may be a plug with an automatic on-off valve that opens the flow path only when these ink packs are intercoupled, or may be selected from the known configurations conventionally employed to close the ink flow path at the time of replacement of ink packs.

In this modified embodiment, the replaceable ink pack 204 is inclined and held by the replaceable pack holder 206 at an upper position than the non-replaceable ink pack 202. In this instance, the ink may flow out into the non-replaceable ink pack 202 through a supply port (for example, spout) located in the vicinity of a lowermost part of the replaceable ink pack 204 in the gravitational direction.

The replaceable ink pack 204 inclined and held by the holder is, specifically, the replaceable ink pack 204 inclined longitudinally relative to the gravitational direction and held by the holder, as illustrated in FIG. 2A. The replaceable ink pack 204 inclined and held by the holder is, more specifically, the replaceable ink pack 204 inclined and held by the holder so that the height in the gravitational direction of the replaceable ink pack 204 held by the replaceable pack holder 206 is smaller than a length L in the lengthwise direction of the replaceable ink pack 204.

This configuration may adequately suppress any difference of the liquid level in the replaceable ink pack 204, and may thereby minimize variability of the hydraulic head differential that may occur during continuous supply of the ink. The replaceable ink pack 204 is longitudinally inclined instead of being horizontally situated. Then, the ink supply to the non-replaceable ink pack 202 may continue even after the liquid level in the replaceable ink pack 204 falls low. According to this modified embodiment, the ink may be supplied more efficiently from the replaceable ink pack 204 to the non-replaceable ink pack 202. The variability of hydraulic head differential according to this modified embodiment will be described later in further detail.

In this modified embodiment of the ink supply apparatus 14, the non-replaceable ink pack 202, as well as the replaceable ink pack 204, may be inclined and set at the position. The non-replaceable ink pack 202 may be inclined so that the ink inlet leading to the replaceable ink pack 204 is at least located more upward in the gravitational direction than the ink outlet of this ink pack leading to the printer 12.

In this modified embodiment, low-cost ink supply to the inkjet head 102 may be feasible by the hydraulic head differential by locating the non-replaceable ink pack 202 at an upper position than the inkjet head 102. Using the hydraulic head differential may be rephrased as using a pressure generated by the hydraulic head differential resulting from a highest liquid level in the non-replaceable ink pack 202 and the replaceable ink pack 204. When the ink is still left in the replaceable ink pack 204, the pressure generated by the hydraulic head differential may be a pressure generated by a difference between the liquid level in the replaceable ink pack 204 and the position of the inkjet head 102. When the replaceable ink pack 204 is emptied, with some ink still left in the non-replaceable ink pack 202 alone, the pressure generated by the hydraulic head differential may be a pressure generated by a difference between the liquid level of the ink in the non-replaceable ink pack 202 and the position of the inkjet head 102.

This modified embodiment, similarly to the earlier embodiment, divides the ink storage capacity of the ink supply apparatus 14 into the non-replaceable ink packs 202 and the replaceable ink packs 204 that are arranged and coupled in multiple stages. Therefore, the replaceably-supported ink packs 204 may be structured or arranged to be readily replaceable. In this modified embodiment, the replaceable ink pack 204 may be a small-sized replaceable ink pack 204 better suited for replacement. Thus, the replaceable ink pack 204 may be easily handled and readily replaceable, and the replacement work may become less of a burden for an operator. These structural features may facilitate replacement of the containers for the ink supply.

This modified embodiment, similarly to the earlier embodiment, uses the replaceable ink pack 204 apart from the non-replaceable ink pack 202. Therefore, the replaceable ink pack 204 may be replaceable during the ongoing ink supply from the non-replaceable ink pack 202 to the inkjet head 102. The printer 12, if uninterruptedly operated for long hours, may continue to be supplied with the ink during the operation. This may further ensure stability of the ink supply to the inkjet head 102.

In this modified embodiment, the replaceable ink pack 204 and the intermediate ink pack 212 may respectively have the sensors 402 and the 404, as in the embodiment described referring to FIG. 1A and FIG. 1B. With such sensors, the ink supply may be properly manageable, as in the embodiment described referring to FIG. 1A and FIG. 1B. In other aspects associated with the ink supply, effects similar to the embodiment described referring to FIG. 1A and FIG. 1B may be attainable by using the ink packs that are arranged in multiple stages.

In this modified embodiment, the replaceable ink pack 204 is inclined and held by the holder so as to suppress variability of the hydraulic head differential. The variability of hydraulic head differential according to this modified embodiment is hereinafter described in further detail.

For the purpose of illustration, the variability is described below in reference to the non-replaceable ink pack 202 and the replaceable ink pack 204 that are equal in length in their lengthwise direction. The non-replaceable ink pack 202 lies longitudinally parallel to the horizontal direction. The non-replaceable ink pack 202 has a length Lm in its lengthwise direction, and a maximum thickness (height) of Wm. The replaceable ink pack 204 has a length L in its lengthwise direction, and a maximum thickness (height) of W. The thickness of the non-replaceable ink pack 202, replaceable ink pack 204 refers to a dimension in a direction in which the thickness changes in response to the changing ink capacity of the ink pack. This is a thickness in a direction orthogonal to the lengthwise direction, as illustrated in the drawing.

In this modified embodiment, the replaceable ink pack 204 is held by the replaceable pack holder 206. Therefore, the uppermost part of the non-replaceable ink pack 202 and the lowermost part of the replaceable ink pack 204 may not always coincide with each other but may be spaced apart with a certain distance (difference in height) therebetween. This distance is defined as L'. The distance L' may be the height of the ink flow path, such as a tube, that intercouples the non-replaceable ink pack 202 and the replaceable ink pack 204.

As illustrated in the drawing, where the hydraulic head differential generated in the lowermost part of the non-replaceable ink pack 202 is a smallest hydraulic head differential H, the hydraulic head differential that generates the supply pressure of the ink to be supplied to the inkjet head 102 is the sum of the smallest hydraulic head differential H and a hydraulic head differential resulting from an uppermost liquid level in intercoupled parts of the non-replaceable ink pack 202 and the replaceable ink pack 204. This hydraulic head differential changes within the range of ΔH illustrated in the drawing.

In this instance, the thickness of the non-replaceable ink pack 202 changes between 0 and Wm in response to the changing ink capacity of this ink pack. The hydraulic head differential, therefore, changes within the range of 0 to Wm in response to the changing ink capacity of the non-replaceable ink pack 202.

In this instance, the thickness of the replaceable ink pack 204 changes between 0 and W in response to the changing ink capacity of this ink pack. Supposing that 0 is an angle of inclination of the replaceable ink pack 204 relative to the horizontal direction, the hydraulic head differential changes between 0 and W×cos θ+L×sin( ) depending on the changing ink capacity of the replaceable ink pack 204.

By the time when the ink in the non-replaceable ink pack 202 starts to decrease after the replaceable ink pack 204 is emptied, the hydraulic head differential changes between 0 to L' in response to the changing liquid level in the flow path that intercouples the replaceable ink pack 204 and the non-replaceable ink pack 202. As a result, the largest variability ΔH of the hydraulic head differential on the whole results in, $$\Delta H = Wm + W \times \cos\theta + L \times \sin\theta + L'.$$

In case the replaceable ink pack 204 is not inclined unlike this modified embodiment, the largest variability ΔH of the hydraulic head differential further increases. FIG. 2B is a drawing of the non-replaceable ink pack 202 and the replaceable ink pack 204 that are longitudinally disposed on each other along the vertical direction. As is clear from the drawing, the largest variability ΔH of the hydraulic head differential equals to 2 L. This arrangement, therefore, causes the hydraulic head differential even more variable than in this modified embodiment. As the hydraulic head differential is more variable, the supply pressure of the ink to be supplied to the inkjet head 102 may be variable in a broader range. This may undermine stability when ejecting the ink droplets.

According to this modified embodiment, the replaceable ink pack 204 is inclined and held by the holder. The total height of the non-replaceable ink pack 202 and the replaceable ink pack 204 may be accordingly reduced as compared to the ink packs 204 and 202 that are longitudinally two-tiered. This may suppress any variability of the hydraulic head differential, allowing the ink droplets to be ejected in a more stable manner.

Another modified embodiment of the printing system 10 is hereinafter described. The description given so far referring to FIG. 2A and FIG. 2B is based on the assumption that the non-replaceable ink pack 202 and the replaceable ink pack 204 are substantially equal in size. When the replaceable ink pack 204 is disposed at an upper position than the non-replaceable ink pack 202, for example, a large-sized non-replaceable ink pack 202 with a large capacity (ultra-large capacity) and a small-sized replaceable ink pack 204 may be combined and used.

Figure 3:
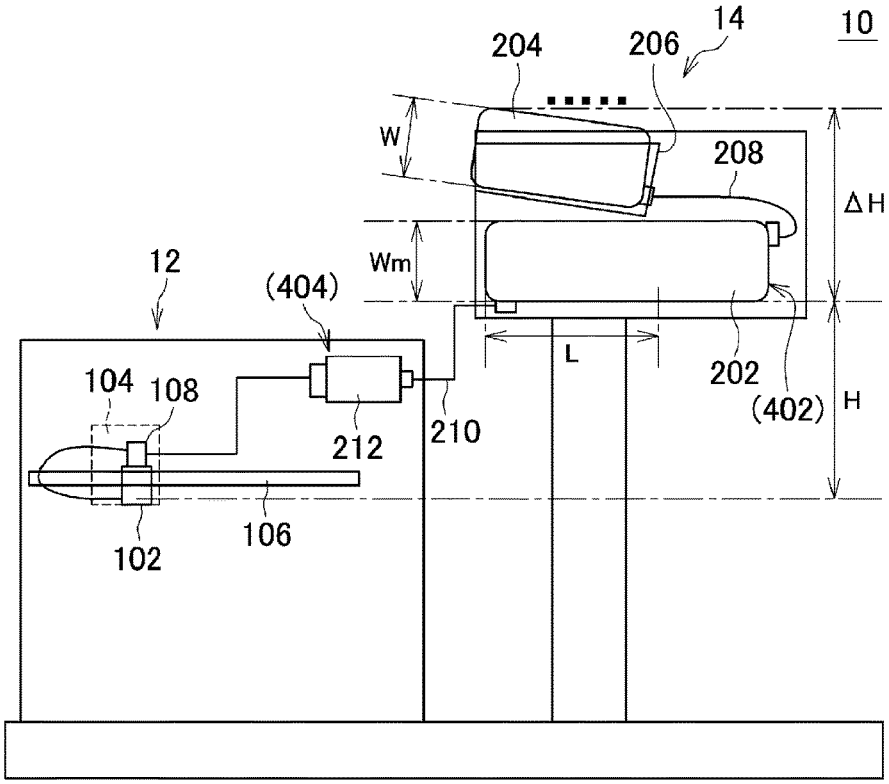
FIG. 3 is a drawing of a second modified embodiment of the printing system 10.

FIG. 3 is a drawing of a second modified embodiment of the printing system 10. Except for the additional features described below, the structural elements illustrated in FIG. 3 with the same reference signs as FIG. 1A to FIG. 2B are identical or similar to those illustrated in FIG. 1A to FIG. 2B.

The replaceable ink pack 204 used in this modified embodiment has a liquid capacity smaller than the non-replaceable ink pack 202. Referring to the drawing, the non-replaceable ink pack 202 has a length greater than L in the lengthwise direction, and the replaceable ink pack 204 is sized smaller than the non-replaceable ink pack 202. The replaceable ink pack 204 thus smaller in size and weight may be easily set at the position. The ink may be automatically supplied from this ink pack to the non-replaceable ink pack 202 without the labor of moving the larger and heavier non-replaceable ink pack 202, and the small-sized replaceable ink pack 204 may be readily replaceable even by an operator who lacks a physical strength.

When multiple replaceable ink packs 204 are replaced one after another with new ink packs, the non-replaceable ink pack 202 may be filled with abundant ink. This may increase an amount of ink that can be uninterruptedly supplied, allowing the printing system 10 to be automatically operated for long hours.

Specifically, the non-replaceable ink pack 202 may have a liquid capacity 1.5 times or more of the liquid capacity of the replaceable ink pack 204. The non-replaceable ink pack 202 may have a liquid capacity twice or more of the liquid capacity of the replaceable ink pack 204.

The non-replaceable ink pack 202 may have a liquid capacity equal to an integral multiple of the liquid capacity of the replaceable ink pack 204. Assuming that the non-replaceable ink pack 202 has a liquid capacity A and the replaceable ink pack 204 has a liquid capacity B, the ink supply apparatus 14 may be supplied with an amount of ink equal to A+B at a timing of the non-replaceable ink pack 202 being filled up with ink. Thus, the ink supply apparatus 14 may be exactly supplied with a maximum possible amount of ink.

For example, the replaceable ink pack 204 with a liquid capacity of 2 L and the non-replaceable ink pack 202 with a larger liquid capacity of 4 L (twice of the replaceable ink pack 204) may be combined and used. After the replaceable ink pack 204 is replaced with a new ink pack twice (and then set in the apparatus) so that the non-replaceable ink pack 202 is filled up with ink, a third new replaceable ink pack 204 is set in the apparatus. As a result, the ink storage capacity amounts to 6 L in total. Such a large amount of ink may allow for an unmanned, long-hour operation of the printing system 10. While the ink droplets are being ejected from the inkjet head 102 of the printer 12, the ink supply may be possible, if necessary, without suspending the printing operation by replacing the replaceable ink pack 204 with a new ink pack. The non-replaceable ink pack 202 may have an even larger liquid capacity of, for example, 6 L which is three times of that of the replaceable ink pack 204. After the replaceable ink pack 204 is replaced with a new ink pack three times (and then set in the apparatus) so that the non-replaceable ink pack 202 is filled up with ink, a fourth new replaceable ink pack 204 is set in the apparatus. As a result, the ink storage capacity amounts to 8 L in total.

Thus, the ink storage capacity in total of the non-replaceable ink pack 202 and the replaceable ink pack 204 may be adequately increased without unnecessarily increasing the capacity of the replaceable ink pack 204. This may provide the ink supply apparatus 14 in which replacement of the replaceable ink pack 204 is facilitated and easily handled.

To improve the efficiency of continuous ink supply using a plurality of ink packs, a larger number of capacious ink packs may be coupled to one inkjet head 102 and sequentially switched to one another. This, however, may require a much larger installation area where all of such large-capacity ink packs can be two-dimensionally arranged, which may significantly increase the ink supply apparatus 14 in size. This modified embodiment may improve the efficiency of continuous ink supply without excessive size increase of the ink supply apparatus 14.

The operations of the sensors that detect the ink capacities (sensors 402 and 404) are hereinafter described in further detail. The operations of the sensors described below may be applicable to the structures described referring to FIG. 2A, FIG. 2B and FIG. 3. The sensor operations may also be applicable to the structure described referring to FIG. 1A and FIG. 1B, if any necessary changes are made.

FIGS. 4A to 4C and FIG. 5 are drawings of examples of a relationship between ink capacity changes in respective portions and timings of ink depletion. The ink capacity changes in respective portions refer to changes in the ink capacity of the replaceable ink pack 204, non-replaceable ink pack 202, intermediate ink pack 212. The timing of ink depletion refers to a timing at which the replaceable ink pack 204, non-replaceable ink pack 202, intermediate ink pack 212 is emptied.

Figure 4A:
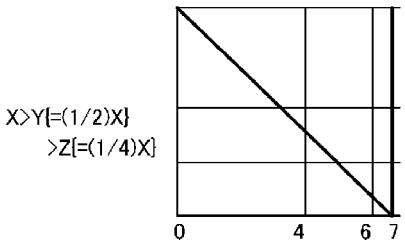
FIGS. 4A to 4C are drawings of an example of uninterrupted ejection time that allows continuous printing (continuous printing time).
Figure 4B:
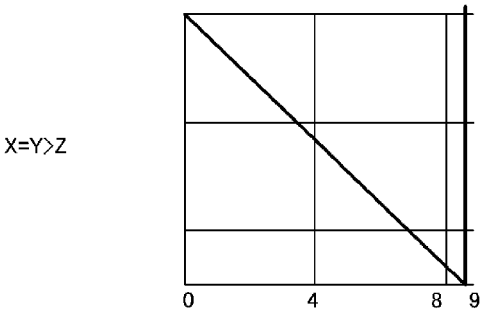
Figure 4C:
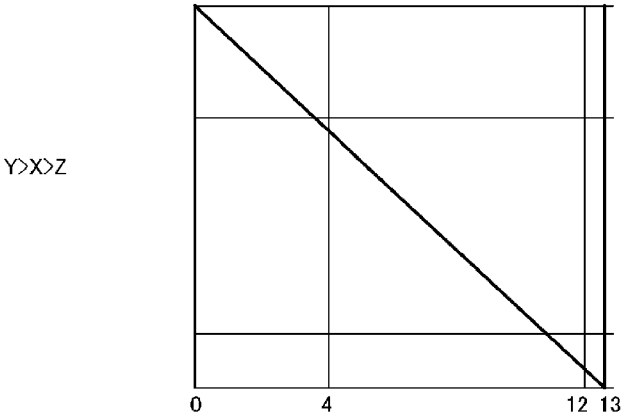

FIGS. 4A to 4C are graphic charts of examples of uninterrupted ejection time that allows continuous printing (continuous printing time) in different magnitude relations among liquid capacities of the replaceable ink pack 204, non-replaceable ink pack 202, and intermediate ink pack 212. In the drawing of FIGS. 4A to 4C are illustrated examples of different magnitude relations among liquid capacities X, Y, and Z of the replaceable ink pack 204, non-replaceable ink pack 202, and intermediate ink pack 212.

FIG. 4 and FIG. 5 are drawings of examples of a relationship between ink capacity changes in respective portions and timings of ink depletion. The ink capacity changes in respective portions refer to changes in the ink capacity of the replaceable ink pack 204, non-replaceable ink pack 202, intermediate ink pack 212. The timing of ink depletion refers to a timing at which the replaceable ink pack 204, non-replaceable ink pack 202, intermediate ink pack 212 is emptied.

FIG. 4 are graphic charts of examples of uninterrupted ejection time that allows continuous printing (continuous printing time) in different magnitude relations among liquid capacities of the replaceable ink pack 204, non-replaceable ink pack 202, and intermediate ink pack 212. In the drawing of FIGS. 4(*a*) to 4(*c*) are illustrated examples of different magnitude relations among liquid capacities X, Y, and Z of the replaceable ink pack 204, non-replaceable ink pack 202, and intermediate ink pack 212.

In all of FIGS. 4A to 4C, the liquid capacity X of the replaceable ink pack 204 is 2 L (liters), and the liquid capacity Z of the intermediate ink pack 212 is (¼)X=0.5 L.

The liquid capacity Y of the non-replaceable ink pack 202 differs among FIGS. 4A to 4C. The liquid capacity Y is Y=(½)X=1 L in the example of FIG. 4A, Y=X=2 L in the example of FIG. 4B, and Y=2X=4 L in the example of FIG. 4C. The ink ejected and used for printing is constantly 500 cc per hour.

The liquid capacity Y of the non-replaceable ink pack 202 differs among FIGS. 4(*a*) to 4(*c*). The liquid capacity Y is Y=(½)X=1 L in the example of FIG. 4(*a*), Y=X=2 L in the example of FIG. 4(*b*), and Y=2X=4 L in the example of FIG. 4(*c*). The ink ejected and used for printing is constantly 500 cc per hour.

Assuming that a printing operation is performed for a printing area of 1 $m^2$ (=$10^6$ $mm^2$) using an inkjet head with 300 nozzles aligned at the density of 150 dpi in a 2-inch region under the conditions of ink (liquid) droplet size: 25 pl (=25 ng), resolution: 600 dpi, and drive frequency: 20 kHz, the ink consumption per 1 $m^2$ in 100% printing is $25\times10^{-9}\times10^{6}/(25.4/600)^2\approx32$ g. At the time, ink consumption of one color ink per hour is $25\times10^{-9}\times2\times10^{4}\times3.6\times10^{3}\times300=5\times10^{-4}\times3.6\times10^{3}\times300=540$ g/hour. Therefore, the ink ejected and used for actual printing may be estimated at approximately 500 cc per hour.

In case the replaceable ink pack 204 is not replaced with a new ink pack in the printing operation under the conditions, the replaceable ink pack 204 will be emptied in 4 hours in all of the examples illustrated in FIGS. 4A to 4C. The non-replaceable ink pack 202, depending on its size, will be emptied in 6, 8, or 12 hours after the printing operation is started, in the examples illustrated in FIGS. 4A to 4C. When one hour is further passed, the intermediate ink pack 212 will also be emptied.

FIG. 5 is a table showing the uninterrupted ejection time in each of the examples illustrated in FIGS. 4A to 4C. As described earlier, the uninterrupted ejection time is 7, 9, or 13 hours in the examples illustrated in FIGS. 4A to 4C.

This result indicates that the uninterrupted ejection time may be optionally increased or decreased by changing the liquid capacity Y of the non-replaceable ink pack 202. When the replaceable ink pack 204 smaller in size is used or the liquid capacity of the intermediate ink pack 212 is prearranged according to the specs of the printer 12, long-hour, continuous operation of the printer 12 may be feasible by changing the liquid capacity Y of the non-replaceable ink pack 202.

When, for example, the ink is continuously ejected for long hours, a warning or other notifying methods may be issued correspondingly to a current ink capacity in total of the ink packs (stage of ink decrease) as described referring to FIG. 1B. FIG. 6A and FIG. 6B are drawings of stages of ink decrease and warnings issued correspondingly to the stages. FIG. 6A is a drawing of a relationship between the stages of ink decrease and timings of issuing the warnings.

The illustrated example suggests three stages of ink decrease; a stage A in which the ink is decreasing in the replaceable ink pack 204 alone, a stage B in which the replaceable ink pack 204 has been emptied, and the ink is decreasing in the non-replaceable ink pack 202, and a stage C in which the replaceable ink pack 204 and the non-replaceable ink pack 202 have both been emptied, and the ink is decreasing in the intermediate ink pack 212. This example further suggests example of timings during the stages of ink decrease, which are timings of issuing the warnings illustrated on the right side of the drawing with numbers 1 to 6 in triangular marks.

The warnings described so far and below may be warning tones or indications displayed on a display unit of the printer 12 or the ink supply apparatus 14, or warning messages may be displayed on a display monitor of a host PC by a control software run to control the printer 12.

FIG. 6B is a table showing events detected at different timings. In the description given below, the apparatus may be further equipped with a sensor at a position corresponding to the replaceable ink pack 204 in addition to the sensors 402 and 404 of the non-replaceable ink pack 202 and the replaceable ink pack 204. In FIG. 6B, numbers 1 to 6 on the leftmost column correspond to the numbers 1 to 6 on the right side of FIG. 6A. The column, place of detection, shows places where the respective events are detected at different timings. A symbol (a) indicates that the sensor of the replaceable ink pack 204 is used for detection. A symbol (b) indicates that the sensor 402 of the non-replaceable ink pack 202 is used for detection. A symbol (c) indicates that the sensor 404 of the intermediate ink pack 212 is used for detection. The column, detected events, shows events detected at different timings.

Among all the timings, the number 1 indicates a timing of all of the ink packs being almost full of ink. This timing is shown for the purpose of reference, indicating that the ink capacity is detected in none of the places of detection.

The number 2 indicates a timing of detection during the stage A. This is a timing at which a predetermined amount of ink in the replaceable ink pack 204 has been consumed. At this timing, the volume (ink capacity) of the replaceable ink pack 204 may have been reduced to a half or to a predetermined volume or less. This may allow the ink capacity to be checked timely during, for example, long-hour, continuous operation (long-hour printing). The arrival of this timing may be accompanied by the issuance of a warning for the detected event, requesting refill of the ink. The warning may be a request for replacement of the replaceable ink pack 204.

The timing with the number 3 is a timing of detection during the stage B, at which the replaceable ink pack 204 has been emptied. At this timing, the sensor 402 of the non-replaceable ink pack 202 may detect that the volume (ink capacity) of this ink pack is starting to decrease. This may allow the ink capacity to be checked more timely during, for example, long-hour, continuous operation (long-hour printing). The arrival of this timing may be accompanied by the issuance of a warning for the detected event, requesting refill of the ink.

The number 4 indicates a timing of detection during the stage B. This is a timing at which a predetermined amount of ink in the non-replaceable ink pack 202 has been consumed. At this timing, the volume (ink capacity) of the non-replaceable ink pack 202 may have been reduced to a half or to a predetermined volume or less. The arrival of this timing may be accompanied by the issuance of a warning for the detected event, notifying that the residual liquid level is falling low in the non-replaceable ink pack 202, and also a warning requesting refill of the ink. In case a huge amount of ink is consumed as in long-hour printing and/or large-area printing, a warning may be useful in response to this timing as well as the timing No. 3.

The timing No. 5 is a timing of detection during the stage C, at which the non-replaceable ink pack 202 has been emptied. At this timing, the sensor 404 of the intermediate ink pack 212 may detect that the volume (ink capacity) of this ink pack is starting to decrease. The arrival of this timing may be accompanied by the issuance of a warning for the detected event, requesting immediate refill of the ink. The printer may be prompted to stop its printing operation in addition to or instead of the warning. Such an operation stop control may be a recommended action in, for example, long-hour printing and/or large-area printing.

The timing No. 6 is a timing of detection during the stage C, at which all of the ink packs have been emptied. At this timing, the sensor 404 of the intermediate ink pack 212 may detect that this ink pack has been emptied. The arrival of this timing may be accompanied by an operation stop control of the printer. In addition to the stop control, a warning notifying the emptied intermediate ink pack 212 may be useful.

As described so far, various messages may be outputted suitably for the different stages of ink decrease. The ink depletion in the replaceable ink pack 204 may be detected while the non-replaceable ink pack 202 and the intermediate ink pack 212 are still containing adequate ink. A warning requesting replacement of the replaceable ink pack 204 may be timely issued while the other ink packs are still containing adequate ink. The printing operation may be stopped, if necessary, which may be an advantage for long-hour, continuous operation.

As described earlier in connection with FIG. 1A and FIG. 1B, the sensor for the replaceable ink pack 204 may be dispensable in the ink supply apparatus 14, in which case, among the detected events at different timings, the events to be detected during the stage A may be unnecessary, insofar as the events detected during and after the stage B of ink decrease are detected. To further simplify the operation of the apparatus, the events to be detected at different timings may be partly omitted. To be specific, the event at the timing No. 4 may not be detected.

While some of the detection timings may be skipped, the events at the timings Nos. 3 and 5 are desirably detected to issue relevant warnings and notify an operator of critical events.

Additional remarks are given below to the printer 12 and the ink supply apparatus 14 described in connection with FIG. 1A to FIG. 6B. In the description so far, the liquid (for example, ink) supply to the inkjet head 102 of the printer 12 is induced by the hydraulic head differential generated between the inkjet head 102 and the non-replaceable ink pack 202 of the ink supply apparatus 14. Any other methods but the hydraulic head differential may be considered for the liquid supply to the inkjet head 102 of the printer 12. It may be suggested to use the hydraulic head differential for the liquid supply from the non-replaceable ink pack 202 to the printer 12 and to use in the printer 12 any other methods but the hydraulic head differential for the liquid to the inkjet head 102. It may also be suggested to use the hydraulic head differential for the liquid supply to the liquid container of the printer 12 and to use, for example, a pump for the liquid supply from the liquid container to the inkjet head 102.

A liquid container in the printer 12 may be useful not only for the pump-used liquid supply but also for the hydraulic head differential-used liquid supply to the inkjet head 102. For example, the printer 12 may be equipped with a third liquid container, which differs from the non-replaceable ink pack 202 and the replaceable ink pack 204. The third liquid container may be disposed in the printer 12 at a position more upstream than the inkjet head 102 in the liquid supply path from the ink supply apparatus 14 to the inkjet head 102. The third liquid container receives the liquid from the non-replaceable ink pack 202 and contains the received liquid inside. The liquid is supplied from the non-replaceable ink pack 202 of the ink supply apparatus 14 to the third liquid container by the hydraulic head differential.

Then, the liquid may be temporarily containable in the third liquid container of the printer 12. This configuration may prevent an unfavorable event, for example, sudden shortage of the liquid during the printing operation (while the inkjet recording apparatus is operating) and may allow the liquid to be reliably supplied to the ejection head. The third liquid container of the printer 12 receives the liquid supplied by the hydraulic head differential from the non-replaceable ink pack 202 of the ink supply apparatus 14. The liquid supply thus performed may dispense with the use of a feed pump.

In the structures described referring to FIG. 1A to FIG. 6B, the intermediate ink pack 212 may be the third liquid container, or the third liquid container may be additionally provided apart from the Intermediate ink pack 212. A sub tank; a small-sized ink container, in the vicinity of the inkjet head 102 may be regarded as the third liquid container.

The printer 12, if the third liquid container is provided therein, may further include a pressure regulator that regulates the supply pressure of the liquid to be supplied to the inkjet head 102 and/or a carriage that holds the inkjet head 102. The pressure regulator may be the pressure damper 108 described in connection with FIG. 1A to FIG. 6B. An example of the pressure regulator may be a mechanical pressure damper that regulates negative pressure using the hydraulic head differential. As the carriage may be used the carriage 104 described in connection with FIG. 1A to FIG. 6B.

The pressure damper 108 may be interposed between the third liquid container and the inkjet head 102 in the liquid flow path and supportably mounted in the carriage 104 with the inkjet head 102. The liquid is supplied by the hydraulic head differential from the third liquid container to the inkjet head 102 through the pressure damper 108.

The technical features of the printer 12 may be applied to various printers equipped with a mechanical pressure damper that regulates negative pressure using the hydraulic head differential. Then, such printers may be supplied with the liquid from the ink supply apparatus 14. In this instance, the liquid supply from the non-replaceable ink pack 202 of the ink supply apparatus 14 to the inkjet head 102 may entirely rely upon the hydraulic head differential. Thus, an electric pressure damper or a feed pump may be dispensed with in a system including the ink supply apparatus 14 and the printer 12. This may reduce the whole apparatus costs, and may also eliminate the risk of possible trouble with the liquid supply due to the breakdown of an electrical system.

While this invention was thus far described in connection with the embodiments, the scope of this invention is not necessarily limited to the technical aspects disclosed herein. Those skilled in the art should obviously understand that the embodiments may be subject to various changes or improvements. As is clearly understood from the appended claims, such changes or improvements are naturally included in the technical scope of this disclosure.

The invention claimed is:

1. A liquid supply apparatus for supplying a liquid to an ejection head of an inkjet recording apparatus, the ejection head ejecting the liquid in a form of droplets using inkjet scheme, the liquid supply apparatus comprising:

a first liquid container, disposed at a position at which the liquid in the first liquid container is suppliable to the inkjet recording apparatus by a hydraulic head differential; and a replaceable container holder, replaceably holding a second liquid container provided apart from the first liquid container, wherein the liquid to be supplied to the first liquid container being containable in the second liquid container at a position preceding the first liquid container, the liquid that the first liquid container receives from the second liquid container being supplied to the inkjet recording apparatus under a pressure generated by the hydraulic head differential, wherein a third liquid container is further provided at a position more upstream than the ejection head in a liquid supply path of the liquid supplied from the liquid supply apparatus to the ejection head, wherein the liquid from the first liquid container is suppliable to and containable in the third liquid container, and the liquid is supplied from the first liquid container to the third liquid container by the hydraulic head differential.

2. The liquid supply apparatus as set forth in claim 1, wherein the inkjet recording apparatus further comprises:

a pressure regulator, regulating a supply pressure of the liquid to be supplied to the ejection head; and a carriage, holding the ejection head, wherein the pressure regulator is disposed at a position between the third liquid container and the ejection head in the liquid supply path and is mounted in the carriage with the ejection head, and the liquid supplied from the third liquid container to the ejection head is performed by using the hydraulic head differential through the pressure regulator.

3. The liquid supply apparatus as set forth in claim 2, wherein the ejection head comprises:

a nozzle, through which the droplets are ejected; and a liquid chamber, in which the liquid is containable at a position preceding the nozzle, the ejection head receives the liquid supplied from the third liquid container through the pressure regulator that regulates a supply pressure of the liquid to be supplied to the ejection head, and the pressure regulator regulates the supply pressure of the liquid to be supplied to the ejection head, so that a pressure applied for a liquid supply to the liquid chamber of the ejection head is lower than atmospheric pressure.

4. The liquid supply apparatus as set forth in claim 1, further comprising:

a checking device, being configured to check a liquid amount in the first liquid container.

5. The liquid supply apparatus as set forth in claim 1, wherein the second liquid container is inclined longitudinally relative to a gravitational direction and held by the replaceable container holder.

6. The liquid supply apparatus as set forth in claim 1, wherein a liquid previously degassed is containable in the second liquid container, and the liquid is supplied from the second liquid container to the ejection head without exposure to air.

7. The liquid supply apparatus as set forth in claim 6, wherein the second liquid container has a capacity variable in response to an amount of the liquid currently contained inside.

8. The liquid supply apparatus as set forth in claim 1, wherein the first liquid container has a capacity variable in response to an amount of the liquid currently contained inside.

9. The liquid supply apparatus as set forth in claim 8, wherein the second liquid container has a capacity variable in response to an amount of the liquid currently contained inside.

10. A liquid supply apparatus for supplying a liquid to an ejection head of an inkjet recording apparatus, the ejection head ejecting the liquid in a form of droplets using inkjet scheme, the liquid supply apparatus comprising:

a first liquid container, disposed at a position at which the liquid in the first liquid container is suppliable to the inkjet recording apparatus by a hydraulic head differential; and a replaceable container holder, replaceably holding a second liquid container provided apart from the first liquid container, wherein the liquid to be supplied to the first liquid container being containable in the second liquid container at a position preceding the first liquid container, the liquid that the first liquid container receives from the second liquid container being supplied to the inkjet recording apparatus under a pressure generated by the hydraulic head differential, wherein the second liquid container is disposed at a lower position in a gravitational direction than the first liquid container, the liquid supply apparatus further comprises: a liquid feeder, feeding the liquid from the second liquid container to the first liquid container, the second liquid container has a liquid capacity larger than a liquid capacity of the first liquid container, the first liquid container is securely disposed in the liquid supply apparatus, the first liquid container and the second liquid container have a capacity variable in response to an amount of the liquid currently contained inside, and the liquid is supplied from the second liquid container to the ejection head without exposure to air while the hydraulic head differential related to the inkjet recording apparatus of the first liquid container is held.

11. A liquid supply apparatus for supplying a liquid to an ejection head of an inkjet recording apparatus, the ejection head ejecting the liquid in a form of droplets using inkjet scheme, the liquid supply apparatus comprising:

a first liquid container, disposed at a position at which the liquid in the first liquid container is suppliable to the inkjet recording apparatus by a hydraulic head differential; and a replaceable container holder, replaceably holding a second liquid container provided apart from the first liquid container, wherein the liquid to be supplied to the first liquid container being containable in the second liquid container at a position preceding the first liquid container, the liquid that the first liquid container receives from the second liquid container being supplied to the inkjet recording apparatus under a pressure generated by the hydraulic head differential, wherein the second liquid container is disposed at an upper position in a gravitational direction than the first liquid container, the first liquid container has a liquid capacity equal to or larger than a liquid capacity of the second liquid container, the first liquid container is securely disposed in the liquid supply apparatus, the first liquid container and the second liquid container have a capacity variable in response to an amount of the liquid currently contained inside, and the liquid is supplied from the second liquid container to the ejection head without exposure to air while the hydraulic head differential related to the inkjet recording apparatus of the first liquid container is held.

* * * * *